US008225929B1

(12) United States Patent
Penkaty

(10) Patent No.: US 8,225,929 B1
(45) Date of Patent: Jul. 24, 2012

(54) DAMAGE INDICATING MATERIAL FOR A REEL

(75) Inventor: Kenneth R Penkaty, South Elgin, IL (US)

(73) Assignee: Reel Guard, Inc., South Elgin, IL (US)

( * ) Notice: Subject to any disclaimer, the term of this patent is extended or adjusted under 35 U.S.C. 154(b) by 0 days.

(21) Appl. No.: 12/687,907

(22) Filed: Jan. 15, 2010

(51) Int. Cl.
*B65B 11/00* (2006.01)

(52) U.S. Cl. ..... 206/400; 242/601; 206/398; 206/401; 53/207; 53/208; 53/397; 53/580

(58) Field of Classification Search ..... 53/204, 53/207, 208, 397, 409, 580; 177/25.15; 705/407; 206/398, 400, 401; 242/118.7, 601, 610, 242/614
See application file for complete search history.

(56) References Cited

U.S. PATENT DOCUMENTS

| | | | | | |
|---|---|---|---|---|---|
| 1,927,403 | A | | 9/1933 | Hoffmann | |
| 1,939,718 | A | * | 12/1933 | Muhlbach | 206/398 |
| 1,941,047 | A | * | 12/1933 | Punte | 206/398 |
| 1,989,183 | A | * | 1/1935 | Blake | 206/414 |
| 2,029,320 | A | * | 2/1936 | Hoffman | 206/398 |
| 2,044,791 | A | * | 6/1936 | Hoffman | 206/398 |
| 2,801,784 | A | | 8/1957 | Blatt | |
| 2,824,481 | A | * | 2/1958 | Johnson | 411/8 |
| 3,059,765 | A | * | 10/1962 | Eifrid | 206/400 |
| 3,329,259 | A | | 7/1967 | Mayer | |
| 4,190,214 | A | * | 2/1980 | Bond | 242/138 |
| 4,513,864 | A | | 4/1985 | Liebel | |
| 4,667,824 | A | | 5/1987 | Ditchfield | |
| 4,850,487 | A | | 7/1989 | Robertson | |
| 4,938,432 | A | | 7/1990 | Kurt et al. | |
| 5,139,208 | A | * | 8/1992 | Schooley | 242/405.2 |
| 5,188,371 | A | | 2/1993 | Edwards | |
| 5,238,113 | A | | 8/1993 | Parrott et al. | |
| 5,580,063 | A | | 12/1996 | Edwards | |
| 5,861,204 | A | | 1/1999 | O'Sullivan | |

(Continued)

FOREIGN PATENT DOCUMENTS

WO 02/02436 A1 1/2002

(Continued)

OTHER PUBLICATIONS

OSP Cable Reel Handling and Storage, Superior Essex, Tech Guideline, pp. 1 and 2, TG08-OSP-Cable-Reel-Handling-and-Storage.pdf, Jun. 24, 2009.

(Continued)

*Primary Examiner* — Rinaldi Rada
*Assistant Examiner* — Eyamindae Jallow
(74) *Attorney, Agent, or Firm* — Patents and Licensing LLC; Daniel W. Juffernbruch

(57) ABSTRACT

A substrate made of a material such as cardboard has characteristics sufficient to visually indicate an occurrence of damage when scraped or punctured to identify damage. The substrate has a flat shape with top and bottom elongated edges and a plurality of breaks along at least the top elongated edge to facilitate bending at a substantially ninety degree angle and be wrapped around a payload carried on a reel at an inner corner where an outside surface of the payload and an inside surface of a flange of the reel meet. The substrate can have a perforated fold parallel to the elongated direction substantially perpendicular to the breaks. The substrate is secured to a reel by stapling, taping or plastic shrink wrapping. A visual warning message can be placed on the substrate to aid forklift drivers.

35 Claims, 9 Drawing Sheets

U.S. PATENT DOCUMENTS

| | | | | |
|---|---|---|---|---|
| 6,155,421 | A | 12/2000 | Cooper | |
| 6,458,448 | B1 | 10/2002 | Hunt | |
| 6,814,232 | B1 | 11/2004 | Morris et al. | |
| 6,935,502 | B1 | 8/2005 | Stoll et al. | |
| 7,080,734 | B1 | 7/2006 | Morris et al. | |
| 7,306,100 | B1 | 12/2007 | Eslambolchi et al. | |
| 7,357,252 | B2 | 4/2008 | Franks | |
| 2002/0005029 | A1 | 1/2002 | Morris et al. | |
| 2002/0007607 | A1 | 1/2002 | Matlack et al. | |
| 2002/0088896 | A1 * | 7/2002 | Gordon | 242/610.2 |
| 2006/0254941 | A1 | 11/2006 | Franks | |
| 2010/0000895 | A1 * | 1/2010 | Weissbrod | 206/395 |

FOREIGN PATENT DOCUMENTS

| | | | |
|---|---|---|---|
| WO | WO 0202436 | A1 * | 1/2002 |

OTHER PUBLICATIONS

Receiving, Handling, and Storage, p. 37, Encore Wire Limited, RHS1.pdf, accessed Jul. 29, 2009.

Plywood Screen, Carris Reels Specification and Quote Sheet for Plywood Screen Reels, plywood_screen.pdf, Mar. 10, 2006.

Wire and Cable Packaging, Handling, and Storage, Sterling Wire & Cable, pp. 1-4, NewWireandCableHandling.pdf, accessed Jul. 28, 2009.

Fiber Optic Cable Storage and Handling Instructions, General Cable, WI-1550-H1 REV:0 pp. 1-6 of 6, Fiber_Optic_Cable_Storage_and_Handling_Instructions.pdf, accessed Jul. 28, 2009.

* cited by examiner

DAMAGE INDICATING MATERIAL FOR A REEL

BACKGROUND OF THE INVENTIONS

1. Technical Field

The present inventions relate to reels and, more particularly, relate to a material for wrapping around a payload carried on a reel.

2. Description of the Related Art

A wide variety of products are shipped and stored on a reel, also known as a spool or bobbin. Examples of such products include wire, cable, thermocouple, fiber optics, rope, cord, and other costly material.

When these reels are shipped, the product payload, such as the wire on the spool, became damaged, for example, by a forklift fork. Replacement of the damaged products caused economic repercussions.

Attempts have been made to protect the product payload on a reel during shipment. Nevertheless shipping material on reels and providing effective protection was not always feasible. Over protection of the product amounted to additional cost such as labor, packaging equipment, nails or screws, pallets/skids. This adds additional weight which increased shipping cost. For example see the heavy wood lagging used in U.S. Pat. No. 4,850,487.

Some attempts to protect the product payload on a reel required wooden reels. This was impractical because today plastic and steel reels are sometimes required for over sea shipments, were wooden spools are forbidden.

One effective protection approach applied lagging to a reel which needed a wooden reel and additional equipment such as a nail gun, nails, and air compressor, for instance. Wood lagging added weight, was labor intensive in application, and removal and was not an environment friendly application.

Another approach was to ship all reels strapped onto pallets. When a reel was on a pallet, a forklift would lift the pallet without touching the reel. Pallets, however, consumed more space in shipping compartments than bare reels. Often one pallet would contain multiple reels. Palleted reels were also more difficult to sort distribute when multiple reels are on a single pallet.

Other approached have been tried but were either unworkable to suffered form problems including those mentioned above.

As such, there is a need in the art for such a product that addresses the problem presented by the exposed payload product on a reel. Damage from forklifts is common and may go undetected until the product is subsequently used. Thus it's critical to minimize unintentional damage and concealed forklift damage during transportation and or storage.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

The details of the preferred embodiments and objects and features of the inventions will be more readily understood from the following detailed description when read in conjunction with the accompanying drawings wherein.

DETAILED DESCRIPTION OF THE PREFERRED EMBODIMENTS

Figure 1:
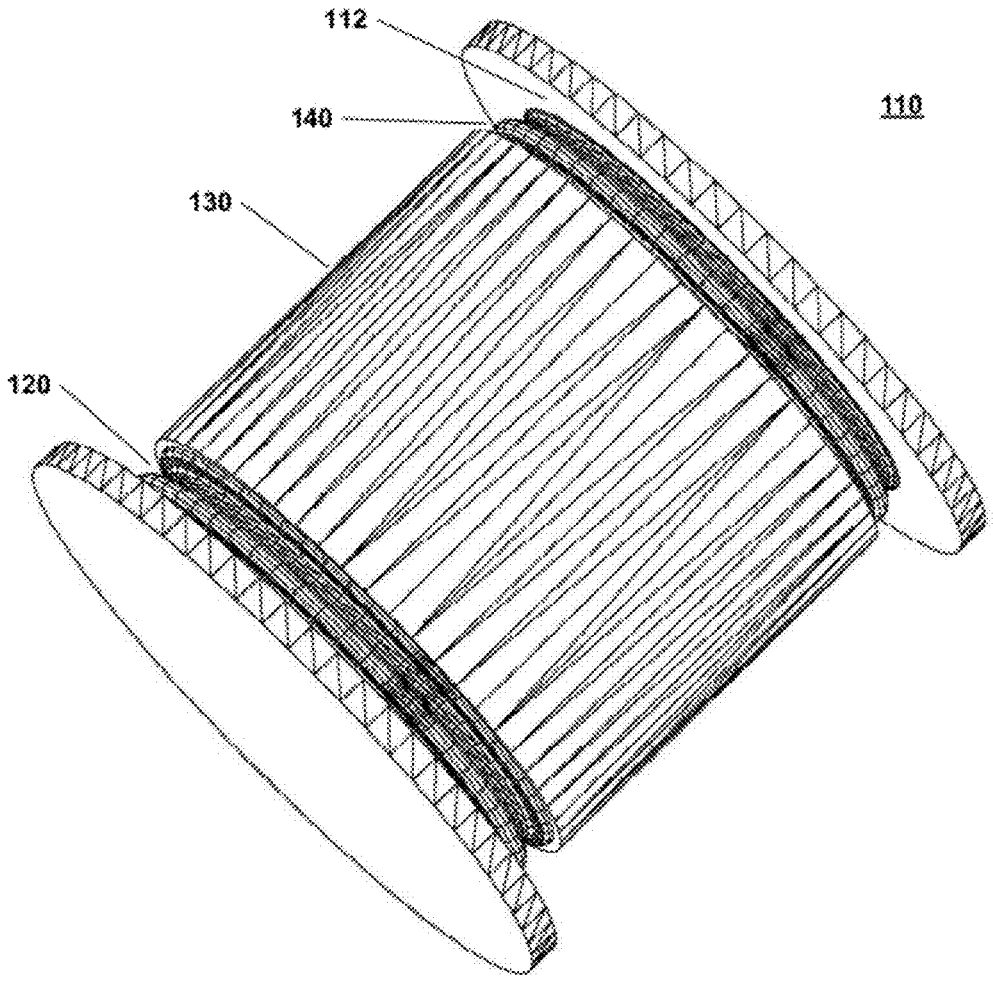
PRIOR ART FIG. 1
FIG. 1 illustrates a three dimensional view of a reel and wire payload with one protective wrap according to the prior art.

FIG. 1 illustrates a three dimensional view of a reel 110 having a wire payload wound thereon for storage and transportation. According to the prior art, a wrap 130 was applied on the reel 110 in an attempt to protect a wire payload. Due to cost restrictions and economic considerations, standard shipments on reels 110 have typically been either shrink wrap or wrapped with cardboard 130 placed between the inside of the flanges 112 as illustrated in prior art FIG. 1. While this approach offered decent protection for the product payload on most of the traverse length of the reel, it has been determined that a small gap was exposed at the inside corners 140 between the product payload and the flange of the reel. The protection, such as that illustrated wrap 130, left gaps exposed at inner corners 140 where an outside surface of the payload and an inside surface of a flange 112 of the reel met. This exposed the payload 120 at the gaps. When transporting or moving material, a folk lift driver sometimes unknowingly extended his folks in-between the product payload and an inside flange 112. This not only caused damage to the product payload, but the forklift driver was unaware of the damage because it was concealed in the gap between the payload product and the inside flange of the reel.

Concealed damage has had a very large impact on not only cost but customer satisfaction. Typically concealed damage was never detected until after a number of workers and equipment such as trenching and pulling equipment and cranes and were at work on job site and the product was being unspooled for deployment. The late detection of damage on a customized wire for specialized applications, for example, caused not only spoiling of the wire, but interruption of a job when it can be least afforded. The number of workers would be out of work and the job significantly delayed for an extended time while a replacement wire spool of this customized wire was delivered.

A guard is provided for wrapping the payload on a reel to indicate damage in the inner corners according to an embodiment. In a further embodiment the guard provides educational and warning messages.

The guard of the present inventions can:

1) minimize concealed damage because it is disposed to indicate damage in the corners were concealed damage to a product payload is most likely—the inside corners where an outside layer of the payload meets an inside end of the reel also known as the flange; and 2) Educate shipping operators such as forklift drivers with a highly visible visual aids that can be seen as the operator performs his normal operational duties. Examples of the visual messages will be later explained with reference to FIGS. 9 and 10.

This guard is a material for wrapping around the payload on a reel to mitigate damage to the payload by offering detection, protection and education. In use, for example, a forklift operation will read a message on the guard to offer education. Then if the forklift operator incorrectly handles the reel during shipment, damage to a wire or other payload will be indicated by a scrape or other visual indication on the guard. Damage is no longer concealed beneath layers of a wire payload because the material offers ready detection. Such concealed damage is particularly mitigated were the payload comes in contact to a corner at an inside side flange of the reel.

Figure 2:
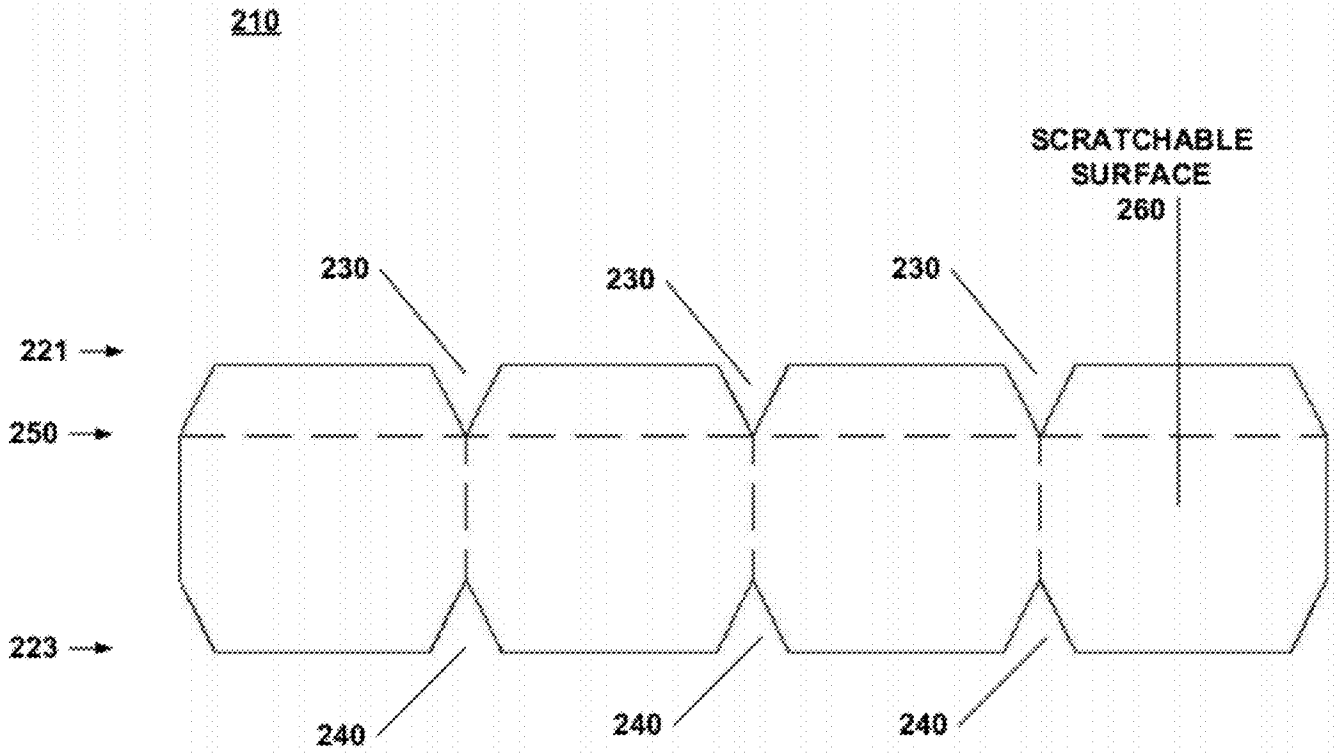
FIG. 2 illustrates a plan view of the guard having octagon shapes according to one exemplary embodiment of the present inventions.

FIG. 2 illustrates a plan view of the guard 210 having a plurality of octagon shapes according to one exemplary embodiment of the present inventions. The guard is a substrate made of a material such as cardboard having characteristics sufficient to visually indicate an occurrence of damage. The material for the flat substrate can be polyethylene, PVC, foam, press board and cardboard. One example of a material having such characteristics is an orange paint-like coating on top of a white cardboard surface that will scrape off and indicate damage when scratched. A scratch can comprise both a scrape on the surface of the material and a puncture through the guard material. The guard material serves to identify damage. Prior attempts focused on protection rather than identification.

While the coating can be an ink it can alternatively be a powder that easily flakes off upon scrape or puncture. One example of an alternative coating is disclosed in U.S. Pat. Nos. 5,188,371 and 5,580,063 by Birchwood Casey used on targets to easier spot bullet penetration.

The substrate has a flat shape with top and bottom elongated edges 221 and 223 and a plurality of breaks 230 along the top elongated edge 221 to facilitate bending around the payload on the reel. A distance between the breaks 230 should be more than about 1 inch (25 mm). A distance between the breaks 230 is a range of about 4 inches (10 cm) to about 8 inches (20 cm). A distance between the breaks is preferably about 6 inches (15 cm).

Figure 3:
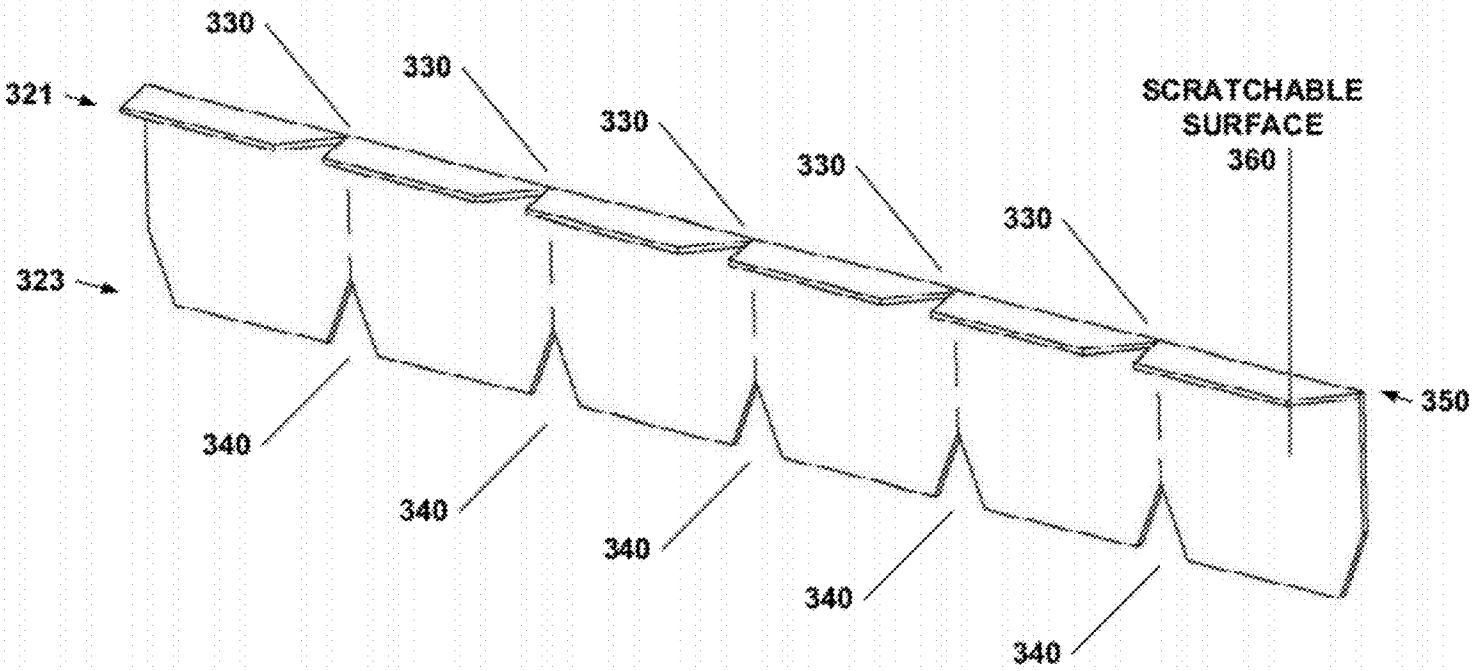
FIG. 3 illustrates a three dimensional view of the guard having octagon shapes according to one exemplary embodiment of the present inventions.

The breaks 230 are preferably v-shaped notches as illustrated in the embodiment of FIGS. 2 and 3, but can be breaks of any shape such as slits, gaps or slots. One alternate break shape will be illustrated with respect to the embodiment of FIGS. 11 and 12. The breaks 230 along the top elongated edge 221 should be of a size and configuration to facilitate securing to an inner flange of the reel such as by stapling, taping or plastic shrink wrapping. A depth or length of each of the breaks should be more than about ¼ inch (6 mm). A depth of each of the breaks is about 1.5 inches (38 mm). A depth of each of the breaks is preferably about ¼ inch (6 mm).

The substrate has additional breaks 240 along a bottom elongated edge to create an octagon or "stop sign" shape in the embodiment of FIG. 2.

A width of the substrate from top elongated edge 221 to bottom elongated edge 223 is approximately equal to the distance between the breaks 230.

The substrate in the embodiment of FIG. 2 has a fold 250 parallel to the elongated direction and substantially perpendicular to the plurality of breaks. The fold 250 preferably has a perforated fold line 250 running between pairs of the plurality of breaks 230 and parallel to the elongated edge to facilitate bending at a substantially ninety degree angle. The substrate of FIG. 2 is capable of wrapping around a payload carried on a reel at an inner corner where an outside surface of the payload and an inside surface of a flange of the reel meet.

An outer surface of the substrate 260 is a visually scratchable. This visually scratchable surface 260 can be accomplished by a coating of a kind capable of being scratched and visually indicate damage. A scratch can comprise both a scrape on the surface of the material and a puncture through the guard material. The guard material serves to identify damage. It is important that this surface is capable if indicating damage of the kind of force produced by a shipping tool such as a fork on a forklift truck. In a preferred embodiment the visually scratchable coating 260 comprises a water based ink which exhibits a contrasting color relative to a color of a surface of substrate such as an orange color on a white color beneath. Additionally the surface is of a kind where an abrasion from an object such as the iron of a fork of a forklift truck will mar the surface and leave some dark iron marks behind on the guard. Thus a color of the outer surface of the substrate should be contrasting in color with that of objects that are likely to hit reels.

FIG. 3 illustrates a three dimensional view of the guard having octagon shapes according to one exemplary embodiment of the present inventions. The substrate has a flat shape with top and bottom elongated edges 321 and 323 and a plurality of breaks 330 along a top elongated edge 321 to facilitate bending around the payload on the reel. The substrate has additional breaks 340 along a bottom elongated edge. A fold 350 runs parallel to the elongated direction of top and bottom elongated edges 321 and 323 and substantially perpendicular to the plurality of breaks 330.

The embodiment of FIG. 3 has five breaks 330 creating six sections. The embodiment of FIG. 2 has three breaks 230 creating four sections. Other embodiments will have a diriment number of breaks. Multiple guards placed in series can be disposed around a reel depending on the circumference of a payload wrapped around a reel. The end of one or more guards can overlap when wrapped.

When the guard indicates damage, the payload can be inspected for damage. A notation can be written on the guard next to the damage mark to indicate the payload has been confirmed as good despite the damage. With a wire or cable payload, for example, when damage is indicated on the guard, the wire or cable can be electrically tested form end to end.

My invention will aid forklift operator in proper handling of a reel, therefore reducing the risk of damage to the product. The unique design as described will be able to fit on as small a reel with a traverse length as small as about 4.5 inches (10 cm) and a flange diameter as small as about 9 inches (23 cm). This leaves a circumference of no more then about 24 inches (55 cm) for a product space leaving not less than about 1.5 inches (3.5 cm) from the most outer layer of product to the end of the flange for proper shipping and application. The unique design as described will also be able to fit on any larger reel.

Figure 4:
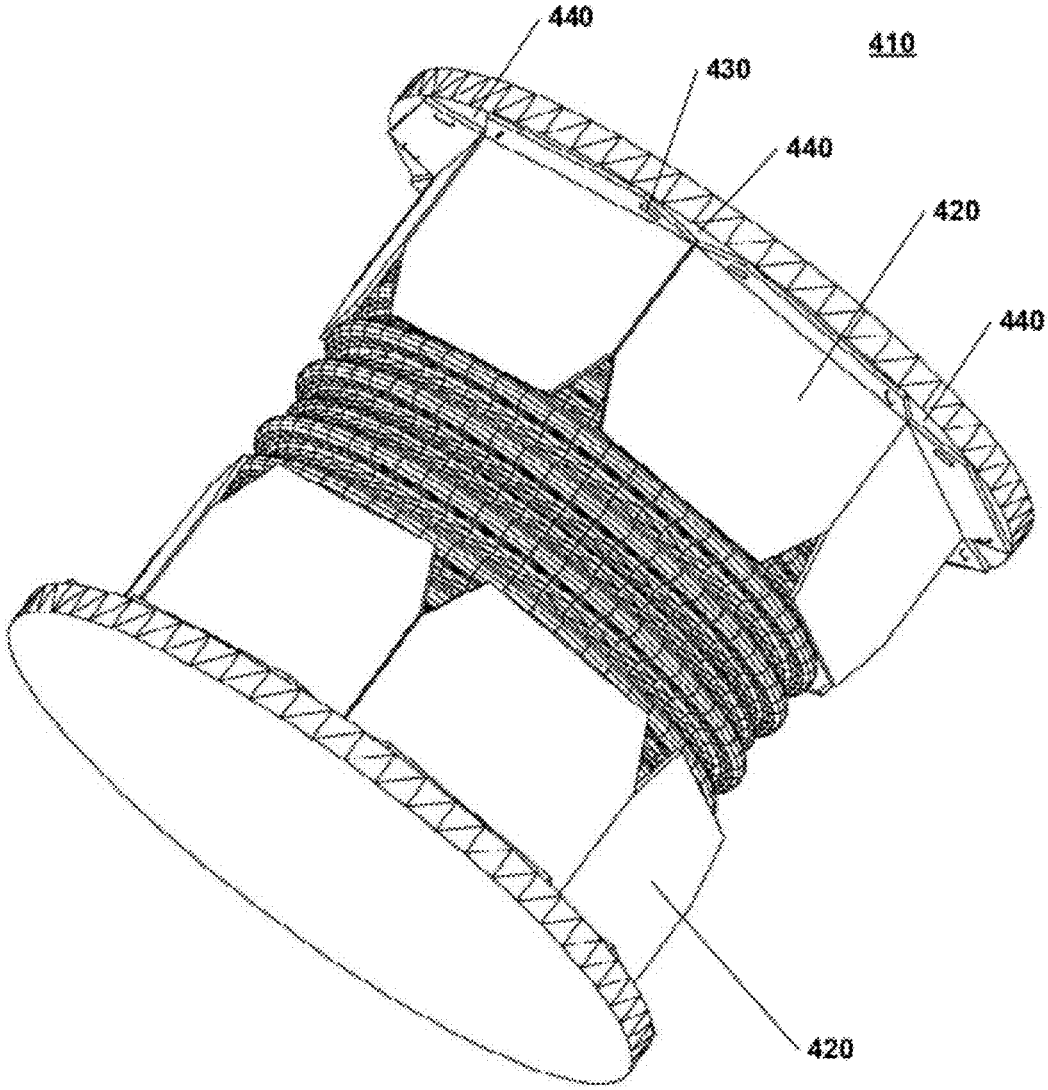
FIG. 4 illustrates a three dimensional view of a wood reel and cable payload with the guard according to one stapled exemplary embodiment of the present inventions.

FIG. 4 illustrates a three dimensional view of a wood reel 410 and a cable or wire payload with the guard 420 according to one stapled exemplary embodiment of the present inventions. The embodiment of FIG. 4 illustrates securing the guard 420 to an inner flange of the reel 410 by stapling. Staples 430 are used to secure the guard 420 to inner flanges of the reel 410. To apply the guard, one simply bends the pre-fabricated area to about a 90 (ninety) degree angle, facing the visual aid message outward. The guard 420 is then be placed in the inside corner were the product payload's meets with the flange. Any visual warning message is facing outward. The exposed payload is thus covered by the guard 420. Using a common industrial hand stapler, staples are preferably applied no less than ½ inch (13 mm) in depth in this exemplary embodiment. Two staples 430 per tap in each opposite edge are preferably used in this exemplary embodiment.

Tools required for use of the guard are of the same standard supplies you will find in everyday distribution warehousing/shipping facility, such as clear tape, shrink wrap and or industrial packaging staples, making my invention less labor intensive (low cost) to apply and will add minimal additional weight. Staple lengths of about ⅜ inches (10 mm) to about ½ inches (12 mm) should do, though longer staples will work. Typically the thickness of the guard would be about ⅛ inches (3 mm), thus longer than ⅛ inches (3 mm) staples would be needed. This in turn will help reduce or keep shipping cost.

Breaks 440 along a top elongated edge of the guard 420 should be of a size and configuration to facilitate securing to inner flanges of the reel 410. A bent elongated edge of the guard 420 is secured against the inside surface of the flange of the reel 410. The staples penetrate through the material of the guard 420 towards the inside surface of the flange of the reel 410 and into the material of the reel 410. A wood or other relatively soft material is need in the flange for stapling.

When a reel has flanges made of a hard material, such as metal or hard plastic, stapling the guard 420 to the reel 410 is impractical. Besides stapling, the guard 420 can be secured or adhered to an inner flange of the reel 410 in other ways, such as taping with clear packing tape or plastic shrink wrapping. The embodiment of FIG. 5 illustrates plastic shrink wrapping.

A guard for plastic and steel reels in addition to wood reels is needed because sometimes on oversea shipments, were wooden spools are forbidden due to wood boring insects, for example.

Figure 5:
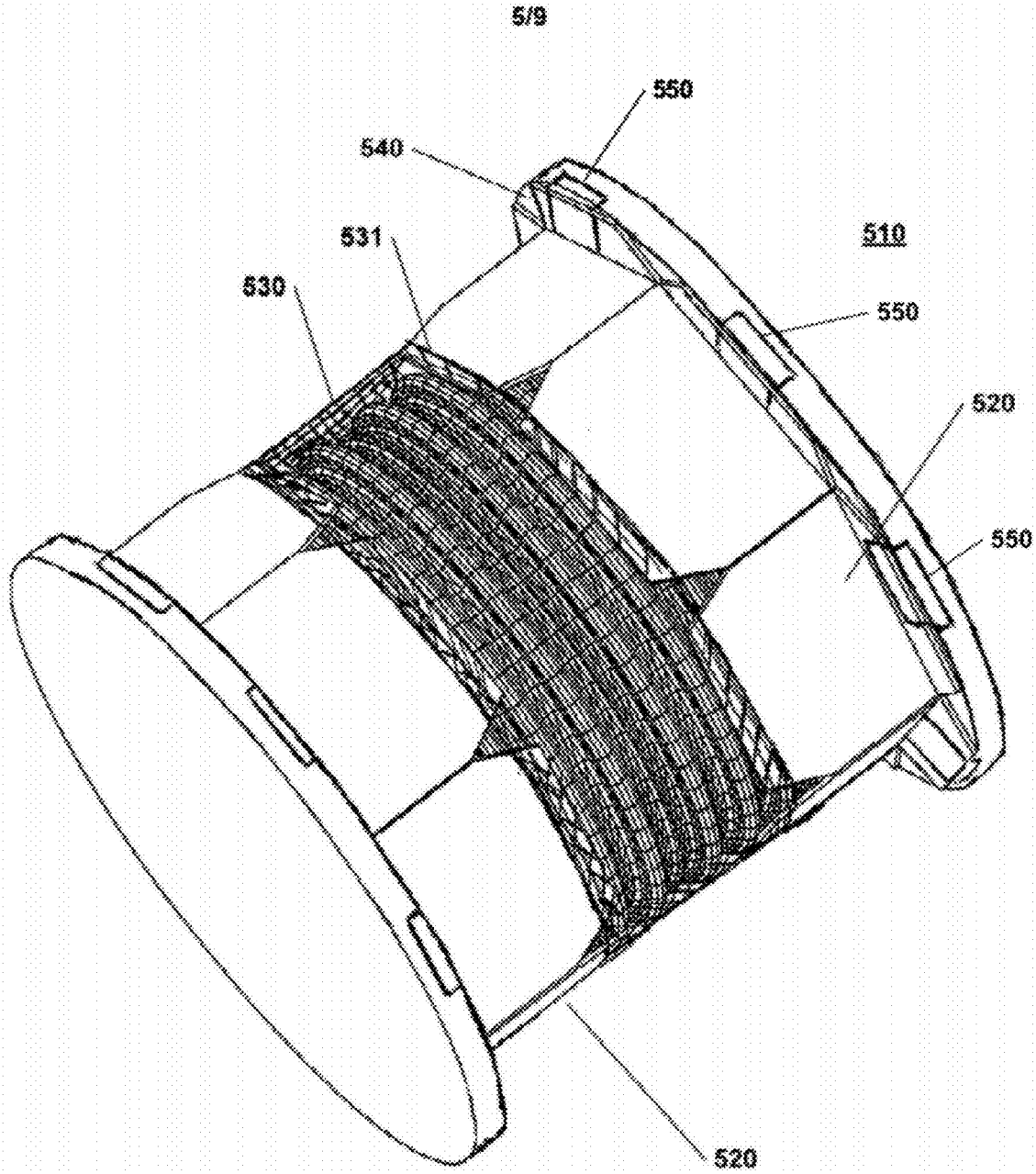
FIG. 5 illustrates a three dimensional view of a non-wood reel and wire payload with the guard according to one plastic wrapped exemplary embodiment of the present inventions.

FIG. 5 illustrates a three dimensional view of a non-wood reel 510, such as one made of metal or plastic. Because staples typically will not adhere to non-wood, shrink-wrap 530 and/or clear tape 550 can be used to adhere the guard 520 to the reel 510.

For application, the product payload is placed on a reel 510. Then the payload is wrapped with shrink wrap. Thereafter the pre-fabricated guard 520 is bent at an approximately 90 degree angle, facing the visual aid out on the product. The guard 520 is then placed in the inside corner where the product edge meets with the inside flange covering the exposed product area. Then a reinforced packing tape, such as that manufactured by Inter Tape polymer group, commonly known as shrink wrap, is wrapped around the exposed product payload and an overlapping portion 531 of guard 520. The width of the overlapping portion 531 is dependent on visual aid messages. It is preferable that the wrap does not cover the visual aid warnings as illustrated in FIG. 5. Nevertheless, if a clear shrink wrap is used, it oaky to cover some or all of the visual aid messages as well though it will be harder to clearly read the warnings. Then clear tape 550 is preferably used to adhere the other end of the guard 520 to the inside flange 540. It is optional whether or not to use the clear adhesive packing tape at 540.

In an alternative implementation, the guard 520 can be adhered to the inside flange of the reel 510 by clear adhesive packing tape 550 but without the shrink wrap 530. Or alternatively the guard 520 can be adhered to the inside flange of the reel 510 by clear the shrink wrap 530 but without the adhesive packing tape 550.

Assuming conventional protective wrapping methods were used such as shrink wrap, chip board, corrugated card board or any such product is applied between the reel flanges, there would be a small gap that was still exposed. This is where forks from forklift trucks do the most damage during moving and handling. The embodiments herein address and solve these and other problems caused by improper handling. The embodiments herein also can function as a highly visible warning and teaching message to illustrate proper handling procedure that can easily been seen by the folk lift operator during normal operation.

Figure 6:
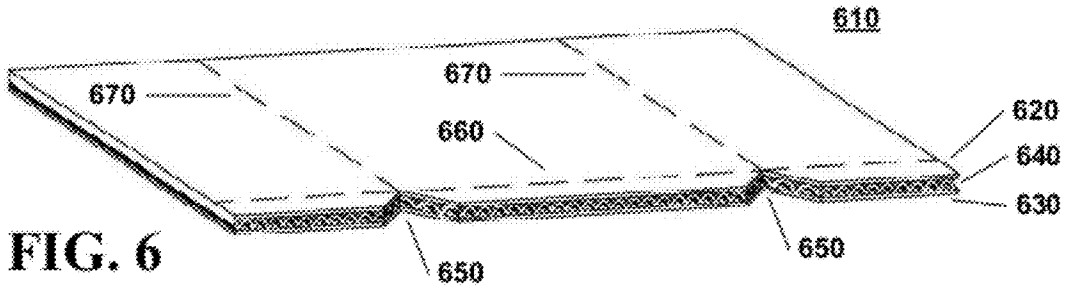
FIGS. 6, 7 and 8 illustrate three dimensional views of three alternative board materials for the guard according to various exemplary embodiments of the present inventions.
Figure 7:
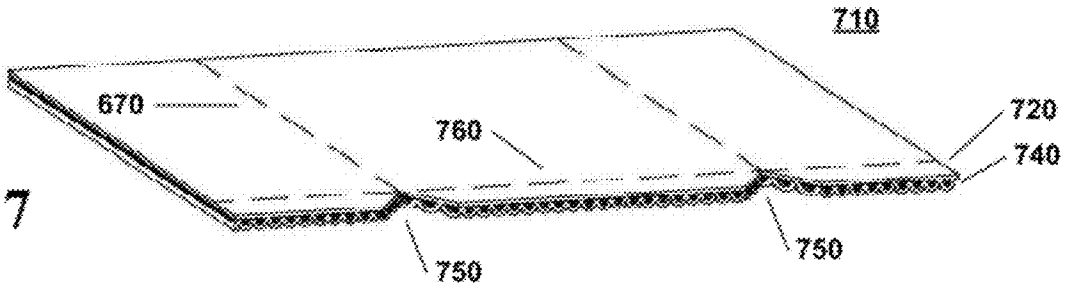
Figure 8:
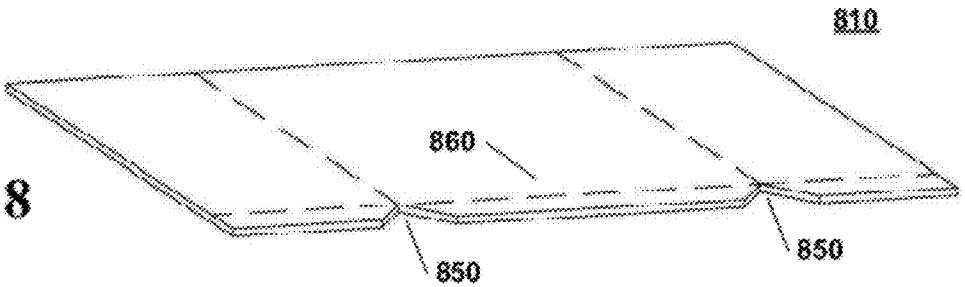

FIGS. 6, 7 and 8 illustrate three dimensional views of three alternative board materials for the guard according to various exemplary embodiments of the present inventions.

FIG. 6 illustrates a double faced corrugated cardboard 610. The cardboard of FIG. 6 comprises corrugated cardboard with at two flat facing liner boards 620 and 630 and a wavy fluted portion 640 therebetween. While this embodiment shows a single wall corrugated cardboard, a multiple wall corrugated cardboard could also be used in an alternative embodiment. The corrugated cardboard preferably has strength of about a 32 edged crush test. The cardboard is a corrugated cardboard with corrugations parallel to the breaks 650 for easy bending in the long direction around a reel. In the embodiment of FIG. 6 the coating and any message is preferably on the one surface. The coating and any message could alternatively go on both surfaces assuming the material can be easily bent in either direction.

The corrugated cardboard substrate in the embodiment of FIG. 6 has fold 660 parallel to an elongated direction and substantially perpendicular to the breaks 650. The fold 660 preferably has a perforated fold line running between pairs of the plurality of breaks 650 and parallel to the elongated edge to facilitate bending at a substantially ninety degree angle. Additional folds 670 can be provided running perpendicular to the elongated direction and parallel to the breaks 650. Because the embodiment of FIG. 6 is corrugated cardboard with corrugations parallel to breaks 650 for easy bending in the long direction around a reel, the additional folds 670 may be omitted depending on the bend-ability or thickness of the flat facing liner board 620.

FIG. 7 illustrates a single face corrugated cardboard 710. The cardboard of FIG. 7 comprises corrugated cardboard with one facing liner board 720 and a wavy fluted portion 740 therebetween. This embodiment is single wall. This embodiment is a single face corrugated cardboard. The corrugated cardboard preferably has strength of about a 32 edged crush test. The cardboard is a corrugated cardboard with corrugations parallel to breaks 750 for easy bending in the long direction around a reel. In the single face embodiment of FIG. 7 the coating and any message is preferably on an outside surface of the facing because a single face corrugated cardboard typically bends better in one direction.

The corrugated cardboard substrate in the embodiment of FIG. 7 as fold 760 parallel to an elongated direction and substantially perpendicular to the breaks 750. The fold 760 preferably has a perforated fold line running between pairs of the plurality of breaks 750 and parallel to the elongated edge to facilitate bending at a substantially ninety degree angle. Additional folds 770 can be provided running perpendicular to the elongated direction and parallel to the breaks 750. Because the embodiment of FIG. 7 is corrugated cardboard with corrugations parallel to breaks 750 for easy bending in the long direction around a reel, the additional folds 770 may be omitted depending on the bend-ability or thickness of the one facing liner board 720.

FIG. 8 illustrates a chip board 810. The chip board can be made of cardboard such as that known as poster board. In the embodiment of FIG. 8 a coating and/or any message is preferably on one surface. The coating and any message could alternatively go on both surfaces assuming the material can be easily bent in either direction.

The chip board substrate in the embodiments of FIG. 8 has fold 860 parallel to an elongated direction and substantially perpendicular to the breaks 850. The fold 860 preferably has a perforated fold line running between pairs of the plurality of breaks and parallel to the elongated edge to facilitate bending at a substantially ninety degree angle. Additional folds 670, 770, 870 can be provided running perpendicular to the elongated direction and parallel to the breaks 650, 750, 850. Because the embodiment of FIGS. 6 and 7 are corrugated cardboard with corrugations parallel to breaks 650, 750 for easy bending in the long direction around a reel, the additional folds 670, 770 may be omitted depending on the bend-ability or thickness of the flat facing liner board 620 or the one facing liner board 720. In the embodiment of FIG. 8 the chip board 810, the additional folds 870 may be omitted depending on the bend-ability or thickness of the chip board 810.

Figure 9:
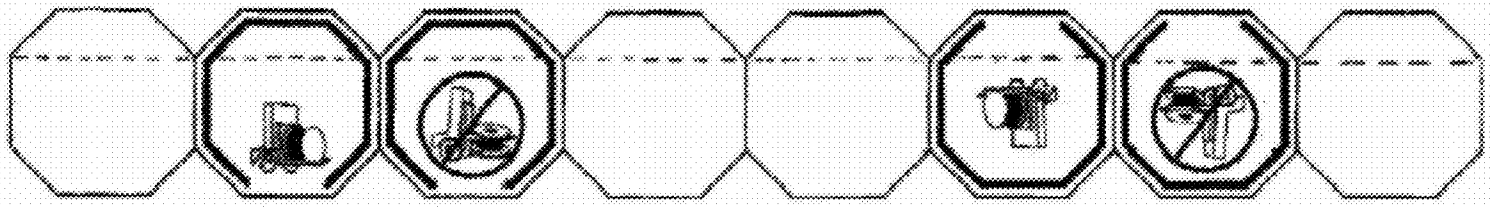
FIGS. 9 and 10 illustrate plan views of messages on the guard according to other exemplary embodiments of the present inventions.
Figure 10:
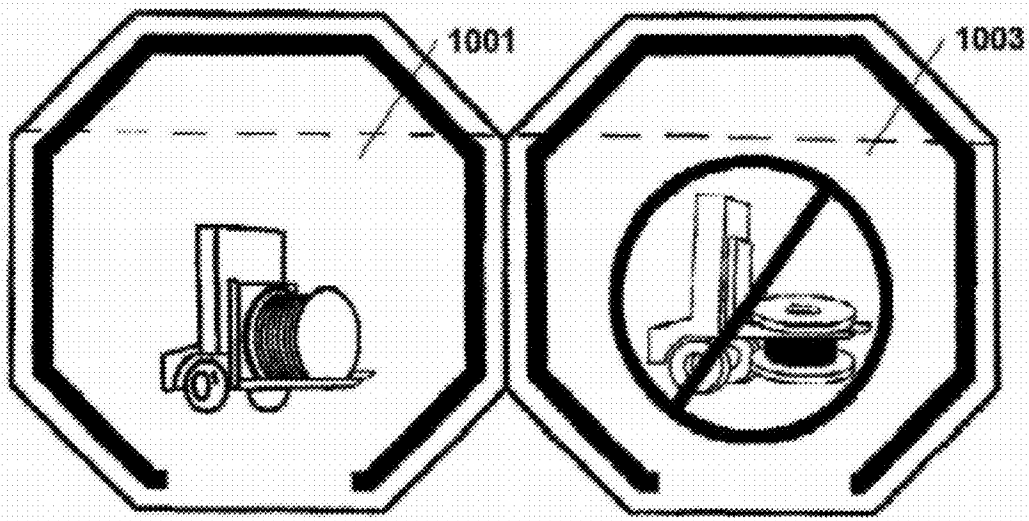

FIGS. 9 and 10 illustrate plan views of messages 1001, 1003 on the guard according to other exemplary embodiments of the present inventions. FIGS. 9 and 10 illustrate one or more universal messages which can easily been seen by an operator under normal forklift operations for transporting a reel. A visual warning message can be placed on one side or both sides of the guard. The visual warning message is placed between notches to display a message within a visually substantial octagon-shaped image. The illustrated visual pictures for proper transportation of product are repeated about every two feet in an alternated right side up and upside down directions for an operator to see. It is preferred that the messages are graphic in nature and serve to warn or teach for example the operator of a forklift truck. One preferred example of the message would be black ink warning messages on a blaze orange background. Other background colors can be any high visible color that is in contrast with not only the message color but also in contrast with the product payload and the reel color. Because reels are typically dark in color, a contrasting color is desirable. Example colors in addition to orange are yellow, green, red, white and blue. Along with a highly visible color not only gives notice, but due to it's bright color, any damage, tears or punctures, even when the brilliant color is marked a white base color will appear, can easily be detected upon inspection. Besides adding the bright color by coating the material, instead of coating, the bright color can be in the material itself or dyed into the composition of the material during manufacturing.

The octagon shape symbolizes a stop sign. This universal, visual precautionary shape is reminiscing to a halt/stop or caution sign, which is customary to everyone. The messages preferably contain an example of how to best carry a reel with a fork of a forklift and a 'do not symbol' icon overlay on a picture of how not to lift a reel with a forklift. The 'do not symbol' icon overlay is a circle with a diagonal line through it (running from top left to bottom right) surrounding a pictogram as specified by ISO 3864-1. It is also know as a prohibition sign, the no symbol, the prohibition sign, the circle-backslash symbol, or universal no.

Throughout where we refer to a reel we intend to also refer to alternate synonyms for a reel such as a spool and a bobbin.

Figure 12:
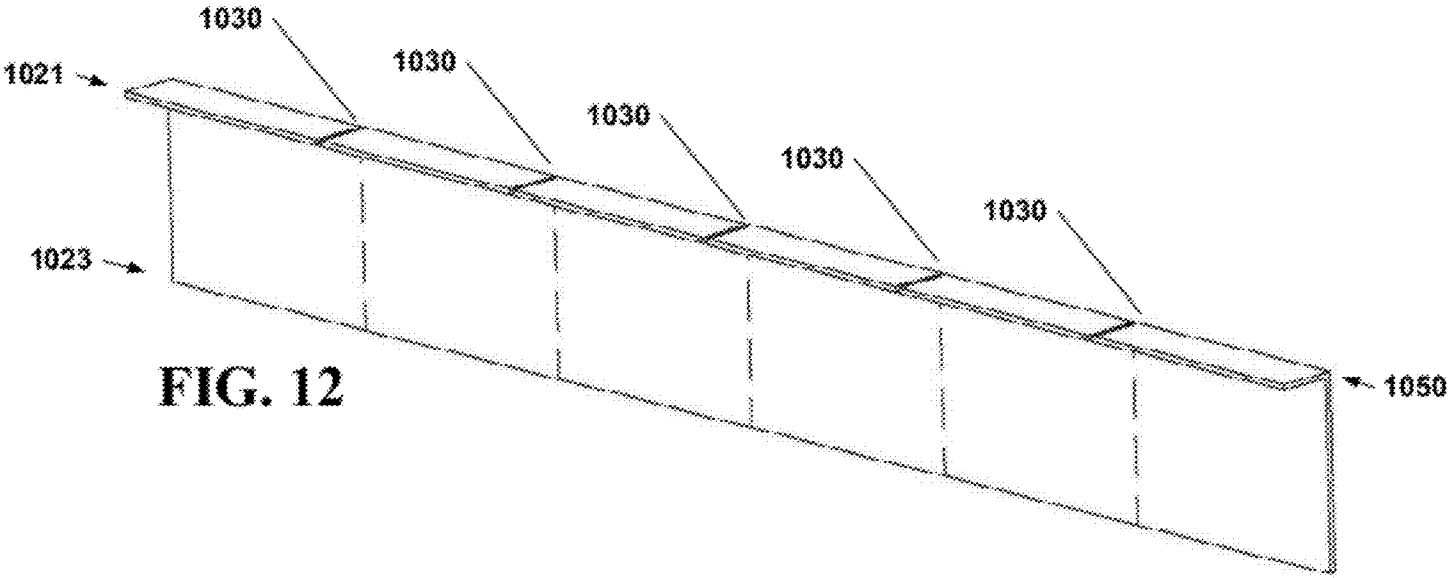
FIG. 12 illustrates a three dimensional view of the guard according to one other exemplary embodiment of the present inventions.
Figure 11:
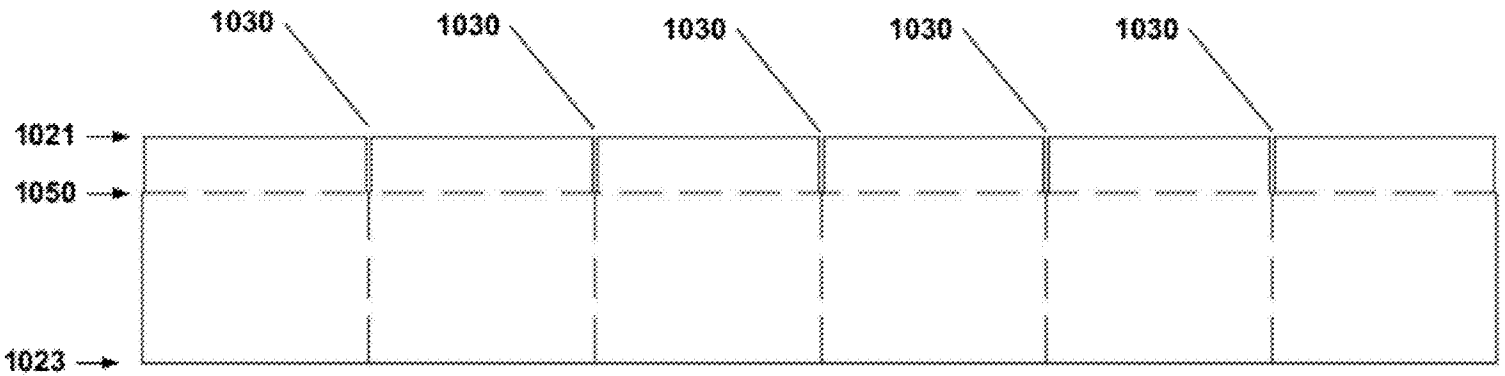
FIG. 11 illustrates a plan view of the guard according to one other exemplary embodiment of the present inventions.

FIG. 11 illustrates a plan view of the guard 1110 according to one other exemplary embodiment of the present inventions. FIG. 12 illustrates a three dimensional view of the guard 1110 according to one other exemplary embodiment of the present inventions.

The guard in FIGS. 11 and 12 has a substrate made of a material such as cardboard having characteristics sufficient to visually indicate an occurrence of damage. The substrate has a flat shape with top and bottom elongated edges 1021 and 1023 and a plurality of breaks 1030 along the top elongated edge 1021 to facilitate bending around the payload on the reel. In the alternate embodiment of FIGS. 11 and 12 the breaks 1030 are preferably slits, gaps or slots.

The substrate illustrated in the alternate embodiment of FIGS. 11 and 12 has no additional breaks along the bottom elongated edge 1023. Although the substrate illustrated in the alternate embodiment of FIGS. 11 and 12 has no additional breaks along the bottom elongated edge 1023, additional breaks along the bottom elongated edge 1023 could be added.

The breaks 1030 along the top elongated edge 1021 are of a size and configuration to facilitate securing to an inner flange of the reel such as by stapling, taping or plastic shrink wrapping. A distance between the breaks 1030 should be more than about 1 inch (25 mm). A distance between the breaks 1030 is a range of about 4 inches (10 cm) to about 8 inches (20 cm). A distance between the breaks 1030 is preferably about 6 inches (15 cm). A depth or length of each of the breaks 1030 from the top elongated edge 1021 to a perforated fold line 1050 should be more than about ¼ inch (6 mm). A depth of each of the breaks 1030 is about 1.5 inches (38 mm). A depth of each of the breaks 1030 is preferably about ¼ inch (6 mm).

Figure 13:
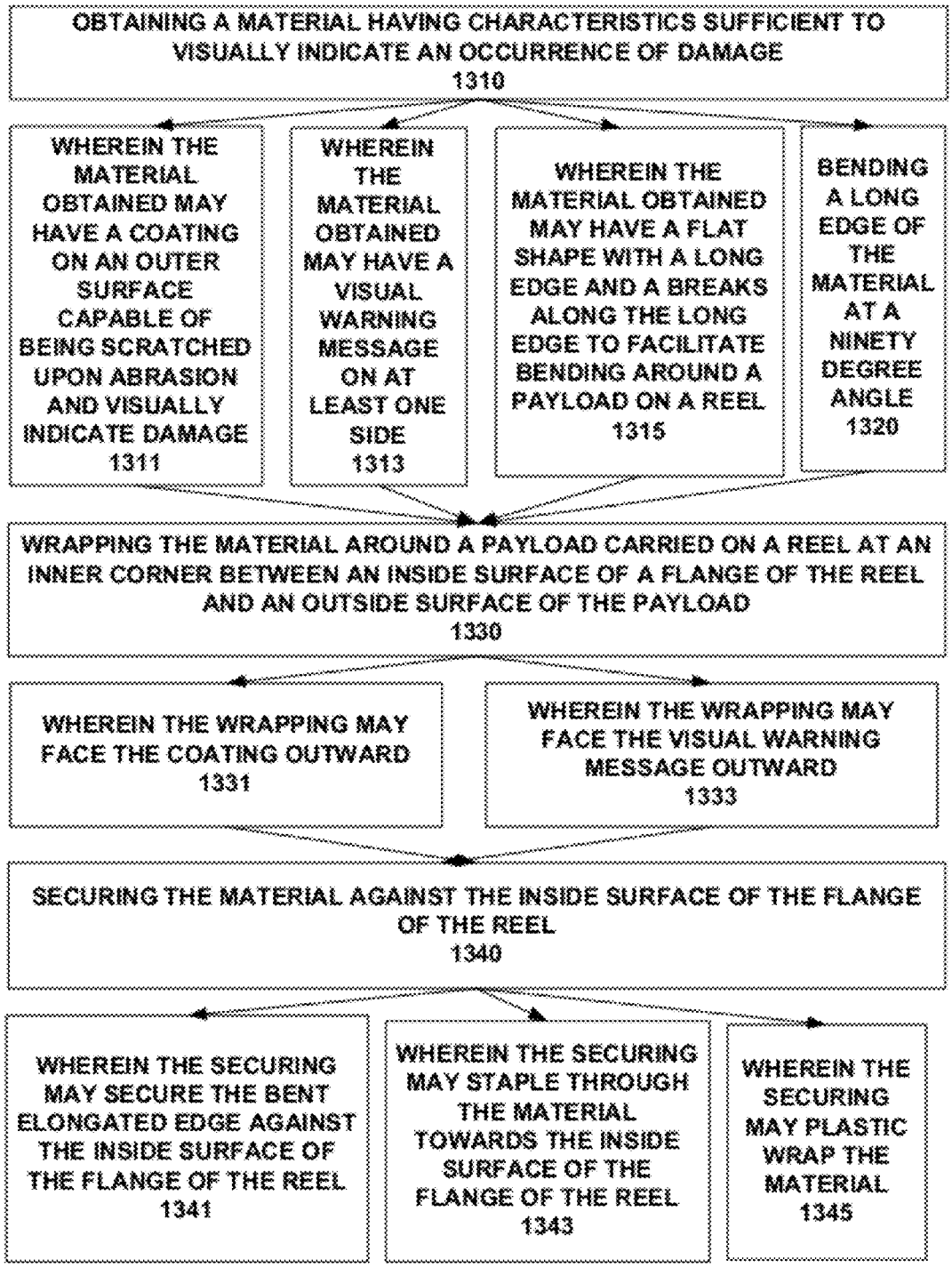
FIG. 13 illustrates a flowchart of steps for using the guard material according to exemplary embodiments of the present inventions.

FIG. 13 illustrates a flowchart of steps for using the guard material according to exemplary embodiments of the present inventions. A material is obtaining having characteristics sufficient to visually indicate an occurrence of damage in step 1310. The material obtained in step 1310 may have a coating on at least an outer surface thereof of a kind capable of being scratched and visually indicate damage 1311. A scratch can comprise both a scrape on the surface of the material and a puncture through the guard material. The guard material serves to identify damage. The material obtained in step 1310 may have a visual warning message on at least one side 1313. The material obtained in step 1310 may have a flat shape with and elongated edge and a plurality of breaks along the elongated edge to facilitate bending around the payload on the reel 1315. In step 1320 an elongated edge of the material is bent at a substantially ninety degree angle. In step 1330 the material is wrapped around a payload carried on a reel at an inner corner between an inside surface of a flange of the reel and an outside surface of the payload. The wrapping of step 1330 may face the coating outward 1331. The wrapping of step 1330 may face the visual warning message outward 1333. In step 1340 the material is secured against the inside surface of the flange of the reel. The securing of step 1340 may secure the bent elongated edge against the inside surface of the flange of the reel 1341. The securing of step 1340 may staple through the material towards the inside surface of the flange of the reel 1343. The securing of step 1340 may plastic wrap the material 1345.

Any letter designations such as (a) or (b) etc. used to label steps of any of the method claims herein are step headers applied for reading convenience and are not to be used in interpreting an order or process sequence of claimed method steps. Any method claims that recite a particular order or process sequence will do so using the words of their text, not the letter designations.

Unless stated otherwise, terms such as "first" and "second" are used to arbitrarily distinguish between the elements such terms describe. Thus, these terms are not necessarily intended to indicate temporal or other prioritization of such elements.

Any trademarks listed herein are the property of their respective owners, and reference herein to such trademarks is generally intended to indicate the source of a particular product or service.

Although the inventions have been described and illustrated in the above description and drawings, it is understood that this description is by example only, and that numerous changes and modifications can be made by those skilled in the art without departing from the true spirit and scope of the inventions. Although the examples in the drawings depict only example constructions and embodiments, alternate embodiments are available given the teachings of the present patent disclosure.

What is claimed is:

1. A substrate comprising a material having characteristics sufficient to visually indicate an occurrence of damage to a payload carried on a reel, wherein the reel with the payload has an inner corner, wherein the inner corner comprises both an outside surface of the payload and an inside surface of a flange of the reel that meet at a corner location, wherein the substrate comprises two elongated edges and a fold running parallel to the elongated edges, and wherein the substrate is bent at the fold and wrapped around the payload at the inner corner of the reel so that the bent substrate covers both the outside surface of the payload and the inside surface of the flange of the reel and the payload is between the substrate and the reel at the corner location where they meet.

2. A substrate according to claim 1, wherein the substrate has a flat shape and further comprises a series of breaks along at least one of the elongated edges to facilitate a radial bend around the payload on the reel so that the payload is between the material and the reel and so that the substrate covers both the outside surface of the payload and the inside surface of the flange of the reel at the corner location where they meet.

3. A substrate according to claim 2, wherein fold runs between pairs of the series of breaks and parallel to the elongated edges to facilitate bending at the fold at a substantially ninety degree angle, wherein a first portion of the substrate on one side of the fold covers the outside surface of the payload and a second portion of the substrate on a side of the fold opposite the first portion covers the inside surface of the flange of the reel.

4. A substrate according to claim 2, wherein a width of the substrate is approximately equal to the distance between the breaks.

5. A substrate according to claim 2, wherein the fold is substantially perpendicular to the series of breaks to facilitate the radial bend around the payload on the reel.

6. A substrate according to claim 2, wherein a depth of each of the breaks is more than about ¼ inch.

7. A substrate according to claim 2, wherein a depth of each of the breaks is about ¼ inch.

8. A substrate according to claim 2, wherein the breaks comprise v-shaped notches.

9. A substrate according to claim 2, wherein the breaks on the one elongated edge are of a size and configuration to facilitate securing such as by stapling to an inner flange of the reel.

10. A substrate according to claim 2, wherein the substrate comprises cardboard.

11. A substrate according to claim 10, wherein the cardboard comprises corrugated cardboard with at least one flat facing liner board and a wavy fluted portion.

12. A substrate according to claim 8, wherein the cardboard comprises a corrugated cardboard with corrugations parallel to the breaks.

13. A substrate according to claim 2, wherein the substrate comprises chip board.

14. A substrate according to claim 1, wherein a distance between the breaks is more than 1 inch.

15. A substrate according to claim 1, wherein a distance between the breaks is about 4 to about 8 inches.

16. A substrate according to claim 15, wherein a distance between the breaks is about 6 inches.

17. A substrate according to claim 1, wherein at least an outer surface of the substrate comprises having characteristics sufficient to visually indicate damage when scratched.

18. A substrate according to claim 17, wherein the abrasion is of the kind of force produced by a shipping tool such as a forklift.

19. A substrate according to claim 1, wherein at least an outer surface of the substrate comprises a coating of a contrasting color relative to a color of a surface of substrate.

20. A substrate according to claim 19, wherein the coating comprises a water based ink.

21. A substrate according to claim 20, wherein the water based ink exhibits a blaze orange color.

22. A substrate according to claim 1, wherein at least an outer surface of the substrate comprises an orange color.

23. A substrate according to claim 1, wherein the substrate comprises a visual warning and teaching message to illustrate proper handling procedure on at least one side.

24. A substrate according to claim 23, wherein the substrate has a flat shape comprising two elongated edges and a plurality of v-shaped notches along at least one of the elongated edges to facilitate the radial bend around the payload on the reel such that an octagon is formed therebetween; and wherein the visual warning and teaching message to illustrate proper handling procedure is placed between notches to display a message within a visually substantial octagon-shaped image.

25. A substrate according to claim 1, wherein the material is chosen from the group consisting of polyethylene, PVC, foam, press board and cardboard.

26. A shipping system comprising the substrate according to claim 1, and further comprising both the payload comprising cable and the reel comprising a cable spool.

27. A shipping system comprising the substrate according to claim 1, and further comprising both the payload comprising cable and the reel comprising a cable spool.

28. A method of wrapping a material around a payload on a reel comprising the steps of (a) obtaining a material comprising two elongated edges and a fold running parallel to the elongated edges, the material having characteristics sufficient to visually indicate an occurrence of damage to a payload carried on a reel, wherein the reel with the payload has an inner corner, wherein the inner corner comprises both an outside surface of the payload and an inside surface of a flange of the reel that meet at a corner location; and (b) bending the material at the fold and wrapping the material around the payload at the corner location so that the payload is between the material and the reel and so that the bent substrate covers both the outside surface of the payload and the inside surface of the flange of the reel at the corner location where they meet.

29. A method according to claim 28, wherein said method further comprises the step of (c) adhering the material to the inside surface of the flange of the reel.

30. A method according to claim 29, wherein the step (c) of adhering comprises the substep of (c1) stapling through the material towards the inside surface of the flange of the reel.

31. A method according to claim 28, wherein said method further comprises the step of (c) securing the material at the inner corner between the inside surface of the flange of the reel and the outside surface of the payload by plastic wrapping an outside surface of the material.

32. A method according to claim 28, wherein the step (a) of obtaining the material comprises the substep of (a1) obtaining the material comprising a coating on at least an outer surface thereof of a kind having characteristics sufficient to visually indicate damage when scratched; and wherein the step (b) of wrapping the material comprises the substep of (b1) wrapping the material with the coating facing outward.

33. A method according to claim 28, wherein the step (a) of obtaining the material comprises the substep of (a1) obtaining the material further comprising a visual warning and teaching message to illustrate proper handling procedure on at least one side; and wherein the step (b) of wrapping the material comprises the substep of (b1) wrapping the material with the visual warning and teaching message to illustrate proper handling procedure facing outward.

34. A method according to claim 28, wherein the step (a) of obtaining the material comprises the substep of (a1) obtaining the material further comprising a substrate having a flat shape comprising a series of breaks along the elongated edge to facilitate radially bending around the payload on the reel so that the payload is between the material and the reel and so that the substrate covers both the outside surface of the payload and the inside surface of the flange of the reel at the corner location where they meet; and wherein the step (b) of wrapping the material comprises the substeps of (b1) bending the material at the fold at a substantially ninety degree angle; and (b2) wrapping the material around the payload carried on the reel at the inner corner so that the substrate covers both the inside surface of the flange of the reel and the outside surface of the payload at the corner location where they meet, wherein a first portion of the substrate on one side of the fold covers the outside surface of the payload and a second portion of the substrate on a side of the fold opposite the first portion covers the inside surface of the flange of the reel.

35. A method according to claim 34, wherein said method further comprises the step of (c) securing the bent elongated edge against the inside surface of the flange of the reel.

* * * * *